US006552707B1

(12) United States Patent
Fujiyoshi

(10) Patent No.: US 6,552,707 B1
(45) Date of Patent: Apr. 22, 2003

(54) DRIVE METHOD FOR LIQUID CRYSTAL DISPLAY DEVICE AND DRIVE CIRCUIT

(75) Inventor: Tatsumi Fujiyoshi, Miyagi-ken (JP)

(73) Assignees: Alps Electric Co., Ltd., Tokyo (JP); LG. Philips LCD Co., Ltd., Seoul (KR)

( * ) Notice: Subject to any disclaimer, the term of this patent is extended or adjusted under 35 U.S.C. 154(b) by 0 days.

(21) Appl. No.: 09/305,109

(22) Filed: May 4, 1999

(30) Foreign Application Priority Data

May 11, 1998 (JP) ..... 10-127951

(51) Int. Cl.[7] ..... G09G 3/36
(52) U.S. Cl. ..... 345/98; 345/100
(58) Field of Search ..... 345/96, 87–103, 345/143; 349/39; 340/784

(56) References Cited

U.S. PATENT DOCUMENTS 5,151,689 A * 9/1992 Kabuto et al. ..... 340/784
6,075,505 A * 6/2000 Shiba et al. ..... 345/87

* cited by examiner

*Primary Examiner*—Steven Saras
*Assistant Examiner*—Srilakshmi K. Kumar
(74) *Attorney, Agent, or Firm*—Brinks Hofer Gilson & Lione

(57) ABSTRACT

There is provided a drive method for a liquid crystal display device in which a line crawling phenomenon is not visually recognized when inversion driving is employed to a liquid crystal display device of a double scanning line system having a lateral-stripe color filter. Polarity inversion is performed every multiple-of-two pixel electrodes such as every two dots, every four dots, . . . , in a direction along a data line, and liquid crystal drive voltages subjected to polarity inversion every two dots controlled by the same data line in a direction along a gate line are applied to pixel electrodes, respectively.

26 Claims, 14 Drawing Sheets

DRIVE METHOD FOR LIQUID CRYSTAL DISPLAY DEVICE AND DRIVE CIRCUIT

BACKGROUND OF THE INVENTION

1. Field of the Invention

The present invention relates to a drive method for a liquid crystal display device and a drive circuit and, more particularly, to a drive method and a drive circuit applied to a liquid crystal device of a double scanning line system having a color filter having a lateral stripe arrangement.

2. Description of the Related Art

In the field of a liquid crystal display device, there is a demand to reduce the cost by reducing the number of expensive data drivers. A TFT substrate having the following structure, is proposed. That is, thin film transistors (to be referred to as TFTs hereinafter) of pixels sandwiching one data line (signal line) are arranged on both the sides of the data line, and these TFTs are driven by different gate lines (scanning lines), respectively. In this structure, since two gate lines are required for one row of pixels arranged along a gate line, although the number of gate lines are twice the number of gate lines of a conventional structure, two rows of pixels laterally arranged on both the side of the data line are driven by one data line arranged between these pixels. For this reason, the number of data lines is half of the number of data lines of the conventional structure. As a result, the number of data drivers can be reduced. In this specification, a drive method for a substrate of this type is called a double scanning line system.

A color filter halving various array patterns is combined to the TFT substrate of the double scanning line system, so that a color liquid crystal display device can be realized. As a drive method for the liquid crystal display device, dot inversion driving which can achieve a high-quality display with high contrast, low crosstalk, and the like as a characteristic feature may be used.

When a liquid crystal display device is to be driven, gate lines are sequentially scanned to turn TFTs on, and a drive voltage is written on liquid crystal capacitors constituted by pixel electrodes, common electrodes, and liquid crystal layers of pixels through data lines. Thereafter, although the written drive voltage is kept after the TFTs are turned off, charges accumulated in the liquid crystal capacitors partially leak through the TFTs with time.

In this case, when the dot inversion driving is employed, dots on which a voltage having a positive polarity is written and dots on which a voltage having a negative polarity is written are regularly arranged in a display area. However, a leakage current characteristic in an OFF state of the TFTs in a positive state is different from that in a negative state. For this reason, a variation in transmittance ratio of a liquid crystal with time in a dot on which a positive voltage is written is made different from that in a dot on which a negative voltage is written.

In a color filter using three colors, i.e., red (R), green (G), and blue (B) as basic colors, the ratio of the transmittance ratios of the respective colors is given by R:G:B=32:55:13. For this reason, a user of a liquid crystal display device visually recognizes a variation in transmittance ratio of a green dot more dominantly.

FIG. 14A shows a pattern so-called lateral stripes in which the same basic colors of the color arrays of the color filter are laterally arrayed, and shows the drive voltage polarities of dots in one arbitrary field. In this manner, when the dot inversion driving is used when the color filter has lateral stripes, G dots (in FIG. 14A, dots enclosed by oval circles) on which a positive voltage is written and G dots (in FIG. 14A, dots enclosed by rectangles) on which a negative voltage is written are laterally arrayed. As shown in FIG. 14B, in a transmittance ratio distribution, wave crests and wave troughs are repeated at a cycle B (in FIG. 14B, crests are indicated by a solid line, and troughs are indicated by a broken line).

Therefore, while the user's eyes pass through the plurality of fields, a so-called line crawling phenomenon in which the crests and troughs of the transmittance ratio distribution are visually recognized such that the crests and troughs flow linearly flow on a screen is generated, and display quality is disadvantageously degraded.

SUMMARY OF THE INVENTION

The present invention has been made to solve the above problem, and has as its object to provide a drive method and a drive circuit for a liquid crystal display device in which a line crawling phenomenon is not visually recognized even if inversion driving is applied to a liquid crystal display device of a double scanning line system having a lateral-stripe color filter.

In order to achieve the above object, a drive method for a liquid crystal display device according to the present invention is characterized by comprising the steps of: arranging a plurality of data lines and a plurality of gate lines on a substrate in the form of a matrix; arranging pixel electrodes controlled by signals of the data lines on both the sides of each data line such that the pixel electrodes correspond to the plurality of gate lines; arranging the plurality of gate lines such that the pixel electrodes on both the sides of the data lines are controlled by signals of gate lines arranged to sandwich these pixel electrodes; controlling adjacent pixel electrodes between adjacent data lines by a signal of one gate line of the gate lines arranged to sandwich the pixel electrodes; controlling adjacent pixel electrodes between adjacent data lines which are adjacent to, through a data line, the adjacent pixel electrodes between the adjacent data lines and adjacent pixel electrodes between adjacent data lines which are adjacent to, through a gate line, the adjacent pixel electrodes between the adjacent data lines controlled by one gate line by a signal of the other gate line of the gate lines arranged to sandwich the pixel electrodes; repeatedly arraying combinations of a plurality of basic colors in the same order with respect to the pixel electrodes arranged along the gate line directions; and, by using a liquid crystal display device having a color filter in which the same basic colors are arranged for the pixel electrodes arranged along the data line directions as an object, performing polarity inversion of every multiple-of-two pixel electrodes in a direction along the data line and adding liquid crystal drive voltages subjected to polarity inversion every multiple-of-two pixel electrodes controlled by the same data line in the direction along the gate line.

The present invention is applied to a liquid crystal display device of a double scanning line system having a lateral-stripe color filter. In addition, even in double scanning line systems, the present invention is applied to a liquid crystal display device having a TFT substrate having a design layout in which, in particular, as described above, two adjacent pixel electrodes between adjacent data lines are controlled by one gate line of two gate lines sandwiching the pixel electrodes, and two adjacent pixel electrodes which are adjacent to the two pixel electrode through the data line and two pixel electrodes which are adjacent to each other through the gate line are controlled by the other gate line.

As in the prior art, when conventional dot inversion driving is applied to a liquid crystal display device of a double scanning line system having a lateral-stripe color filter, a line crawling phenomenon caused by the crests and troughs of a transmittance ratio distribution is generated.

In contrast to this, according to the present invention, simple dot inversion driving is not performed to the liquid crystal display device using the double scanning line system having the above design layout, but the following driving is performed to the liquid crystal display device, so that visual recognition of the line crawling phenomenon can be suppressed. That is, polarity inversion of every multiple-of-two pixel electrodes such as every two pixel electrodes, every four pixel electrodes, . . . , in a direction along a data line, and polarity inversion of every two pixel electrodes connected to the same data line in a direction along a gate line.

Polarity inversion inherent in the present invention is performed, so that the following two effects are achieved.

(1) The cycle of a transmittance ratio distribution can be shortened (interval between crests). In other words, the spatial frequency of a variation in transmittance ratio can be made high.

(2) The present invention can give periodicity to a transmittance ratio distribution such that portions corresponding to the crests and troughs of the transmittance ratio distribution do not uniformly continue in a longitudinal direction, but the crests and troughs alternately appear.

With respect to (1), since the visibility of a variation in transmittance ratio has a characteristic that the variation in transmittance ratio is easily checked as the spatial frequency becomes low, the variation in transmittance ratio is not easily checked as the spatial frequency becomes high. With respect to (2), when portions corresponding to the crests and troughs continue to have large lengths, the portions are easily recognized as one line, and the portions are not easily visually recognized such that the crests and troughs are alternately intermittent. In this manner, according to the drive method of the present invention, visual recognition of a line crawling phenomenon can be suppressed by the two effects. The effects will be described below with concrete examples in the embodiments of the present invention.

As the arrangement of a drive circuit for realizing the drive method, an arrangement having the following components can be used. That is, the arrangement has a gate driver for sequentially outputting gate voltages to one gate line and the other gate line of the plurality of gate lines in two fields, respectively, a data driver for outputting liquid crystal drive voltages of pixel electrodes corresponding to the gate lines to which the gate voltage is output, and a control circuit for inverting the polarities of the liquid crystal drive voltages output from the data driver to the plurality of data lines every multiple-of-two pixel electrodes in a direction along the data line, generating a polarity control signal for performing polarity inversion of every two pixel electrodes controlled by the same data line in a direction along the gate line, and outputting the polarity control signal to the data driver.

More specifically, the gate driver can be constituted by a circuit having two sets of shift registers and level shifters for outputting gate voltages to two series of gate lines called one gate line and the other gate line as described above. As the data driver, a generally available data driver can be used. Image data of basic colors such as R, G, and B are generally assigned to three data buses. In the present invention, since the number of data lines in the liquid crystal display device of the present invention is half of the number of data lines in the conventional liquid crystal display device, interpolation and replacement of data are performed, and the data on the data buses do not correspond to the image data of the basic colors.

The control circuit can be generally constituted by an ASIC such as a gate array or the like. The control circuit may be constituted by an arrangement having a circuit portion constituted by a latch, a multiplexer, and the like for supplying an image signal to the data driver and a circuit portion constituted by a horizontal counter, a vertical counter, a pulse decoder, and the like for generating a polarity control signal for regularly inverting the polarity of the liquid crystal drive voltage as described above.

In the liquid crystal display device to which the present invention is applied, advantages such as cost reduction and low power consumption can be achieved. For this reason, the present invention is suitable for the field of the liquid crystal display device such as a portable terminal which is particularly desired to be reduced in weight and size. Therefore, the present invention is suitably applied to the liquid crystal display device in which the diagonal size of a screen is about 3 to 10 inches, and a dot pitch is about 30 to 300 pm (depending on a pixel capacity).

BRIEF DESCRIPTION OF THE DRAWINGS

FIG. 4 includes charts for explaining video data processing in the control logic circuit, in which

FIG. 14 includes charts showing the drive voltage polarities and transmittance ratio distribution of dots one arbitrary field in a conventional drive method, in which

DESCRIPTION OF THE PREFERRED EMBODIMENTS

First Embodiment

The first embodiment of the present invention will be described below with reference to FIGS. 1 to 9.

Figure 1:
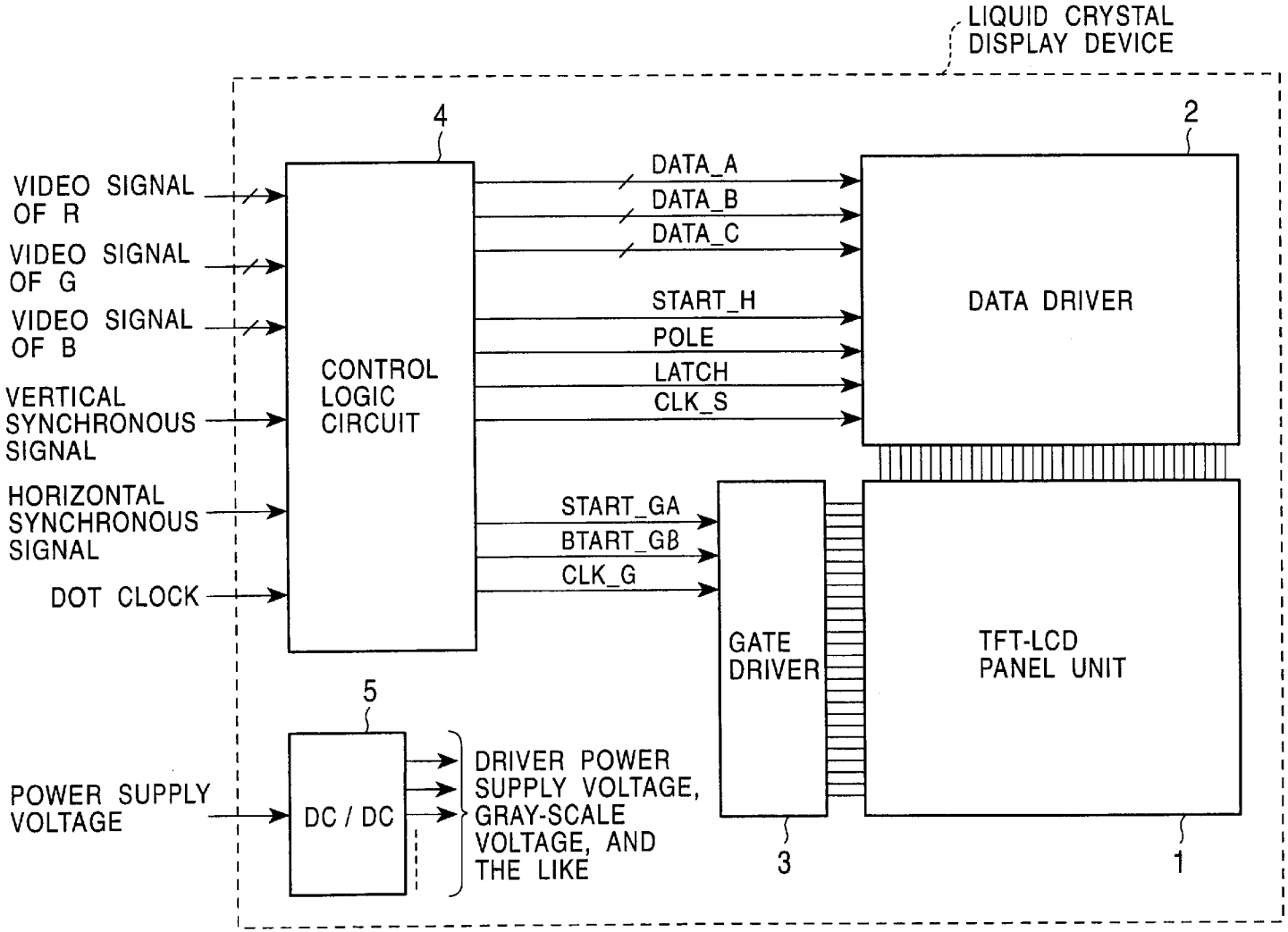
FIG. 1 is a block$_1$diagram showing the brief arrangement of a liquid crystal display device according to the first embodiment of the present invention.

FIG. 1 shows the brief arrangement of a liquid crystal display device according to this embodiment. The liquid crystal display device, as shown in FIG. 1, a TFT-LCD panel unit 1, a data driver 2 serving as a drive circuit for the panel 1, a gate driver 3, a control logic circuit 4 (control circuit), a DC voltage transforming circuit 5 (described as a DC/DC in FIG. 1), and the like. In the TFT-LCD panel unit 1, a VGA (the number of dots is 640×3×480) in which the diagonal size of a screen is 6.5 inches is used, and a dot pitch is 70 μm. Digital video signals, vertical synchronous signals, horizontal synchronous signals, and dot clocks of the colors R, G, and B are input to the control logic circuit 4, and a power supply voltage is input to the DC voltage transforming circuit 5. Although a driver power supply voltage, a gray-scale voltage, and the like are supplied from the DC voltage transforming circuit 5 to the drivers 2 and 3, a description of this portion will be omitted because the portion is not different from that of the prior art. The liquid crystal display device has a color filter having lateral stripes consisting of basic colors R, G, and B (not shown).

Figure 2:
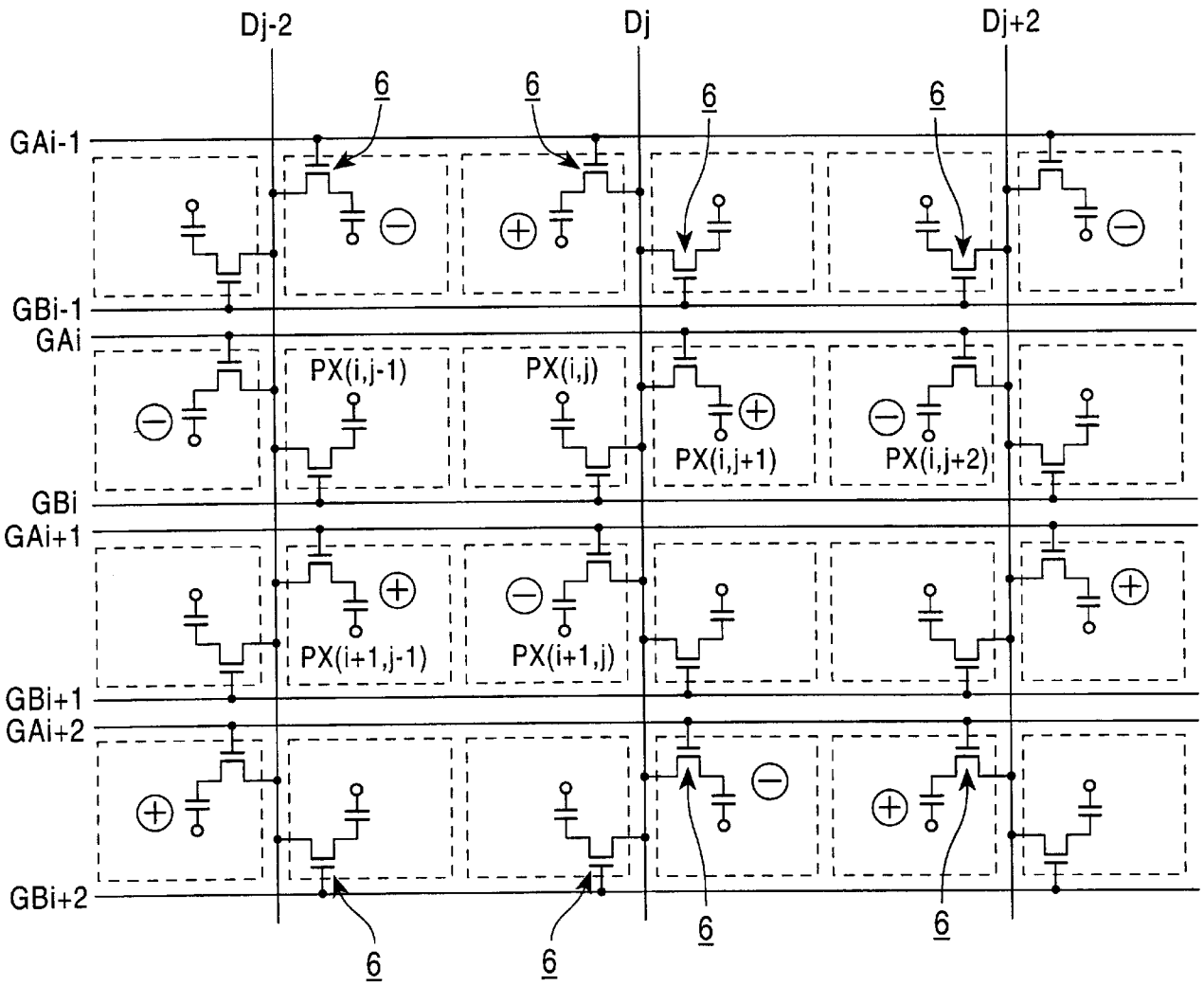
FIG. 2 is an equivalent circuit diagram showing the arrangement of a TFT-LCD panel unit of the liquid crystal display device in FIG. 2.

FIG. 2 is the equivalent circuit of the TFT-LCD panel unit 1. The circuit is, of one of double scanning line systems. Rectangles indicated by broken lines denote respective dots PX(i,j) (i=1 to m, j=1 to n), and one pixel is constituted by three dots (R, G, and B). As shown in FIG. 2, in the TFT-LCD panel unit 1, n/2 data lines (signal lines) are arranged to divide all dot arrays PX(i,j) (i=1 to m, j=1 to n) into arrays each having two columns, and each data line is connected to the source terminals of TFTs 6 of 2m dots on both the sides of the corresponding data line. In FIG. 1, only three data lines Dj−2, Dj, and Dj+2 are shown. With respect to each row, a first gate line GAi (i=1 to m) and a second gate line GBi (i=1 to m) are arranged to sandwich n: dots constituting each row from both the sides. 2m gate lines (scanning lines) are arranged as a whole.

When two adjacent dots between adjacent data lines, e.g., dots Px(i,j−1) and PX(i,j) are regarded, a gate voltage is supplied from the second gate line GBi to the dots PX(i,j−1) and PX(i,j). A gate voltage is supplied from the first gate line GAi to two dots Px(i,j+1) and PX(i,j+2) which are adjacent to the dots PX(i,j−1) and PX(i,j) through a.data line Dj, and a gate voltage is supplied from a first gate line GAi+1 to two dots PX(i+1,j−1) which are adjacent to the dots PX(i,j−1) and PX(i,j) through the gate line GBi.

The polarities of liquid crystal drive voltages according to this embodiment are inverted every two dots connected to the same data line in the direction along a gate line, and inverted: every two dots in the direction along a data line. Therefore, in FIG. 2, the polarity of a drive voltage in a field in which the first gate line GAi (i=1 to m) is represented by "+" or "−" in a broken-line rectangle.

Figure 3:
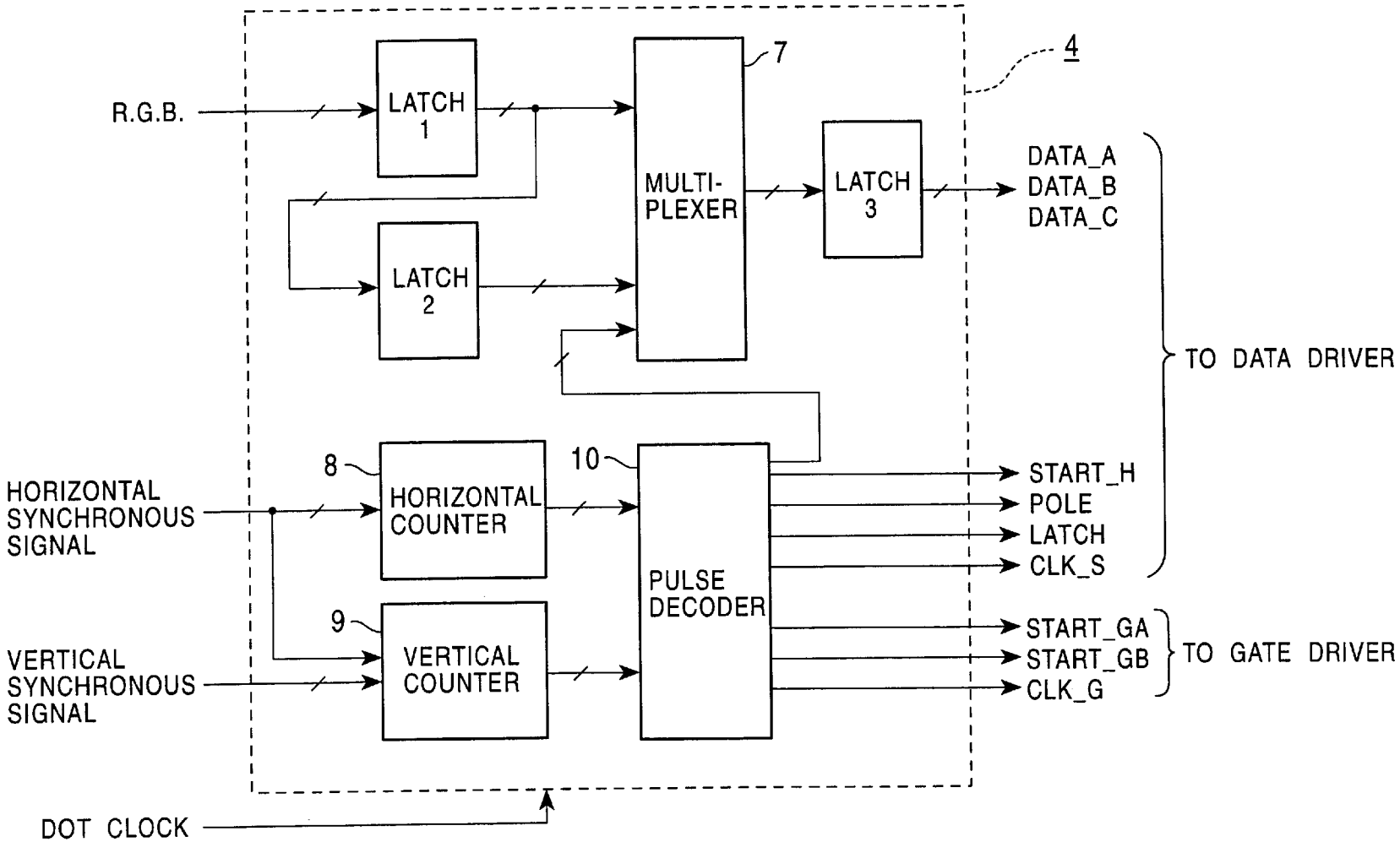
FIG. 3 is a block diagram showing the inner arrangement of a control logic circuit in the drive circuit in the liquid crystal display device in FIG. 2.

FIG. 3 shows the inner arrangement of the control logic circuit 4. As shown in FIG. 3, the control logic circuit 4 has a portion, constituted by a latch 1, a latch 2, a latch 3, and a multiplexer 7, for generating data buses DATA-A, DATA-B, and DATA-C, and a portion, constituted by a horizontal counter 8, a vertical counter 9, and a pulse decoder 10, for generating various signals START-H, POLE, LATCH, CLK-S, START-GAI, START-GB, AND CLK-G. Of outputs from the control logic circuit 4, data buses DATA-A, DATA-B, and DATA-C and signals START-H, POLE, LATCH, and CLK-S are output to the data driver 2. The signals START-GA, START-GB, and CLK-G are output to the gate driver 3.

Figure 4A:
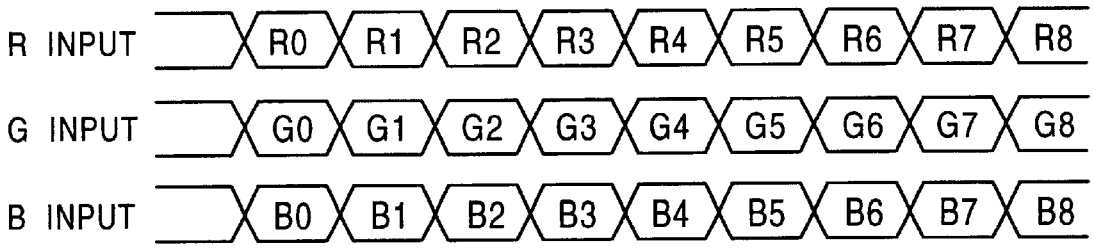
FIG. 4A is a chart for explaining original video signals of R, G, and B.
Figure 4B:
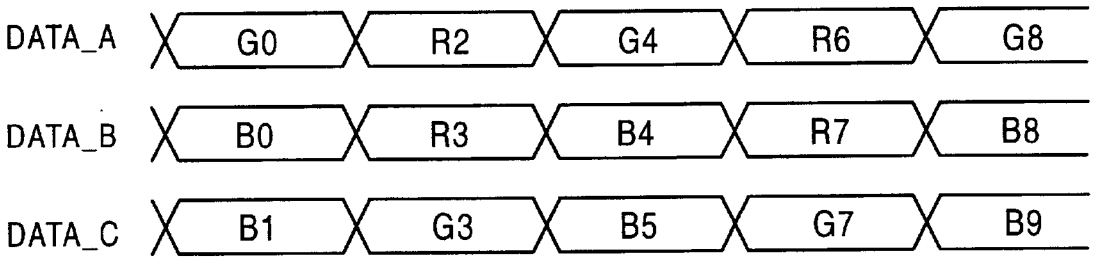
FIG. 4B is a chart for explaining results obtained after interpolation and replacement of data are performed.
Figure 4C:
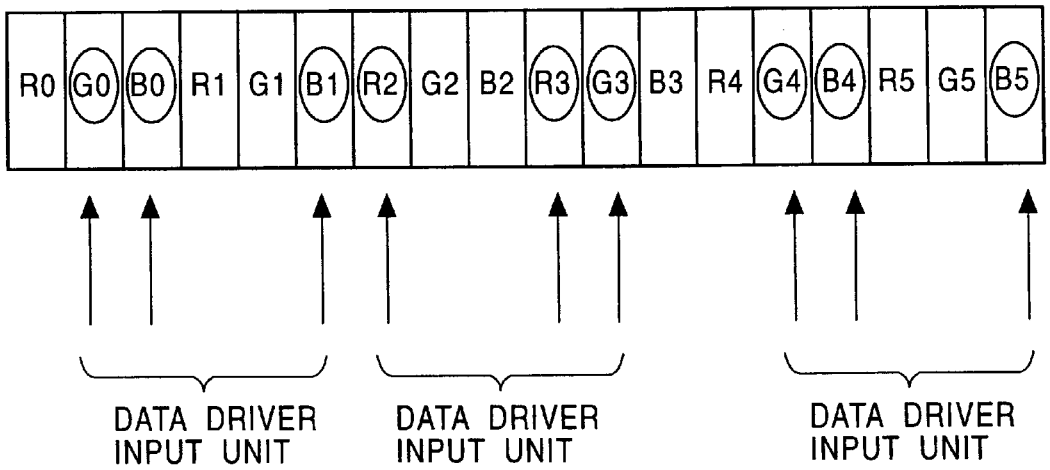
FIG. 4C is a chart for explaining units for inputting a data bus to a data driver.

The generated data buses DATA-A, DATA-B, and DATA-C are generated by interpolation and replacement of data on the basis of original video signals R, G, and B input to the control logic circuit 4. More specifically, as shown in FIG. 4A, the original video signals R, G, and B are given by R0, R1, R2, . . . , G0, G1, G2,. . . , and B0, B1, B2, . . . , each color. However, when interpolation and replacement of the data are performed, as shown in FIG. 4B, the data bus DATA-A becomes a data string G0, R2, G4, . . . , the data bus DATA-B becomes a data string B0, R3, B4, . . . , and the data bus DATA-C becomes a data string B1, G3, B5, . . . . In addition, units for inputting the data buses DATA-A, DATA-B, and DATA-C to the data driver 2 are given by units shown in FIG. 4C in accordance with a timing at which a gate line is scanned.

The START-H signal is to control the start of receiving data on the data buses DATA-A, DATA-B, and DATA-C, the POLE signal is to control the polarity of a liquid crystal drive voltage output from the data driver 2, and the LATCH signal is to control a timing of serial/parallel conversion of data and an output timing. CLK-S denotes serial image data, START-GA and START-GB denote scanning start pulses corresponding to the first gate line GAi and the second gate line GBi, and CLK-G denotes a gate clock.

In the control logic circuit 4, the horizontal counter 8 and the vertical counter 9 are controlled by a horizontal synchronous signal and a vertical synchronous signal to be a sequencer, and control signals of the data driver 2 and the gate driver 3 are generated by the pulse decoder 10. A control signal for interpolation and replacement of data is also generated by the pulse decoder 10 to control the multiplexer 7, and the data buses DATA-A, DATA-B, and DATA-C.

Figure 5:
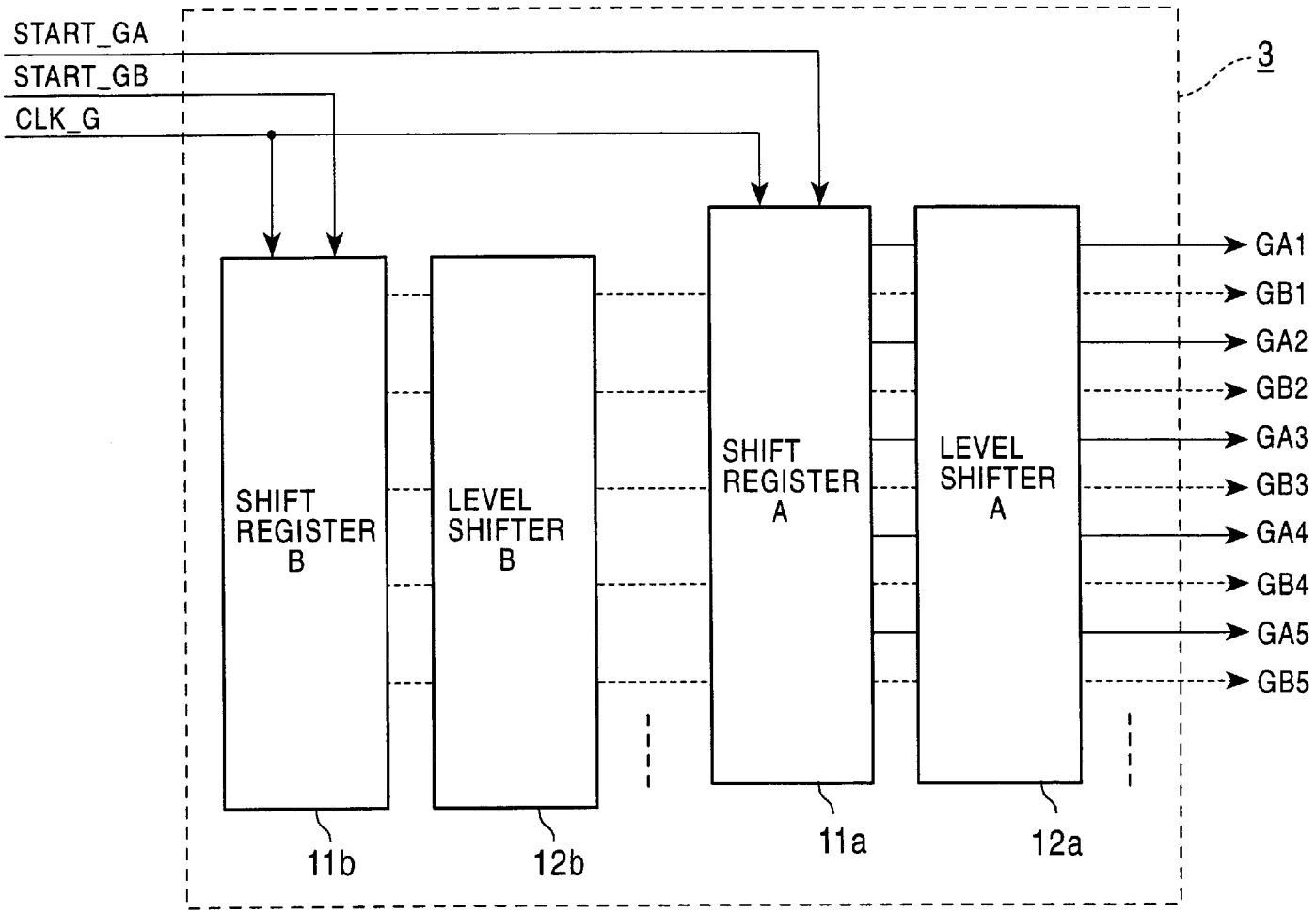
FIG. 5 is a block diagram showing the inner arrangement of a gate driver in the drive circuit.

The data driver 2 is generally available. Data of one gate line is received into an inner line memory by serial image data CLK-S through the data buses DATA-A, DATA-B, and DATA-C, and image data corresponding to the gate line are simultaneously output to the TFT-LCD panel unit 1 in accordance with the timing of the gate driver 3. The gate driver 3 in this embodiment is obtained such that a circuit is not externally formed on a TFT substrate, but a circuit is directly formed on a TFT substrate. As shown in FIG. 5, the gate driver 3 is constituted by two sets of shift registers 11*a* and 11*b* and level shifters 12*a* and 12*b*. Scanning start pulse as START-GA and START-GB are alternately input from the control logic circuit 4 every field. Gates GA1, GA2, . . . , are sequentially activated in one field, and gates GB1, GB2, . . . , are sequentially activated in the other field.

When a liquid-crystal display device of a double scanning line system according to the present invention is to be subjected to inversion driving, the liquid crystal display device includes a field in which the first gate lines GAi (i=1 to m),are sequentially scanned, a field in which the second gate lines GBi (i=1 to m) are sequentially scanned, a field in which a positive voltage is applied to one arbitrary dot in each field, and a field in which a negative voltage is applied to one arbitrary dot in each field. For this reason, one frame is constituted by four fields.

Figure 6:
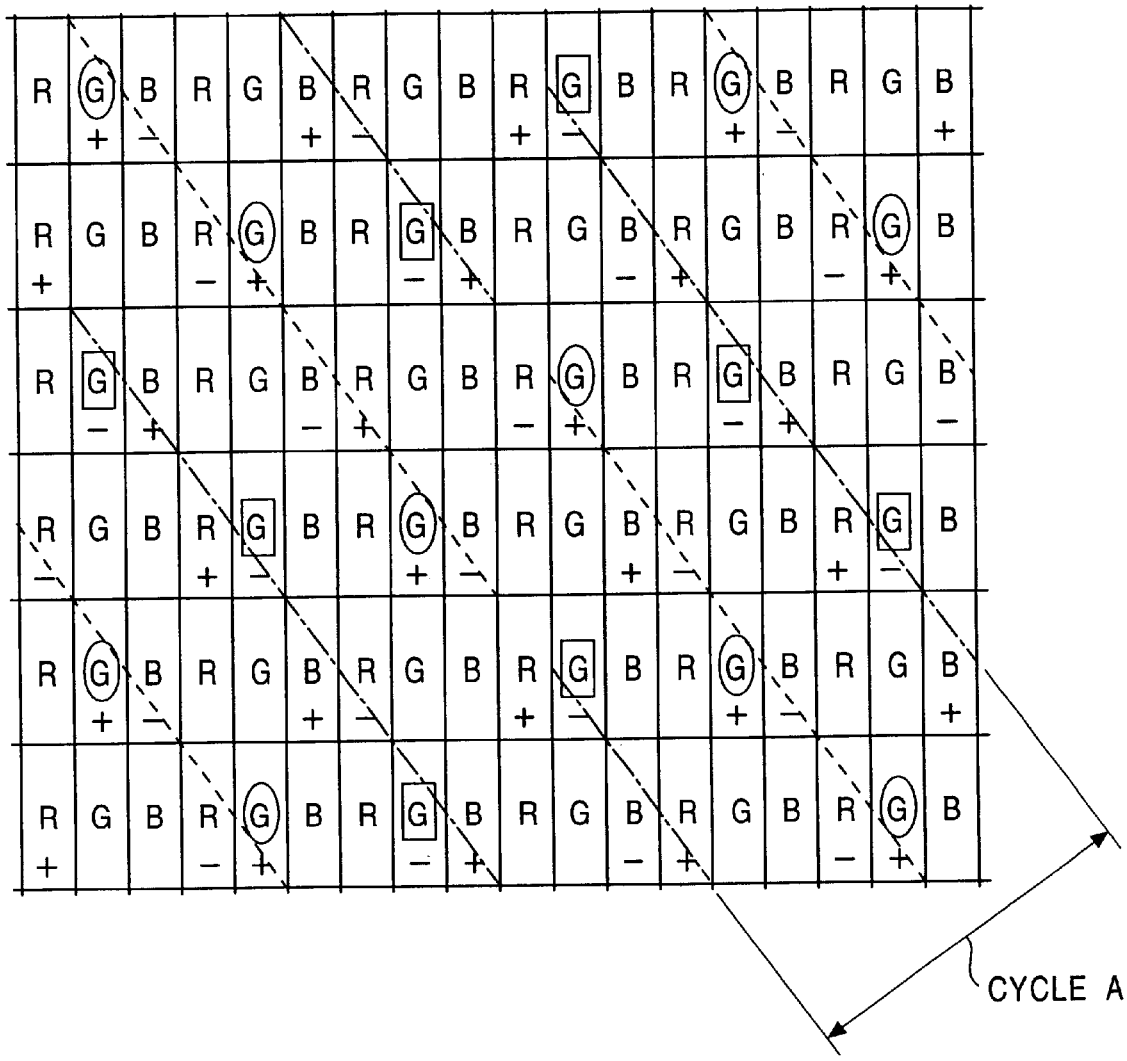
FIG. 6 is a chart.showing the drive voltage polarities and transmittance ratio distribution of dots in the first field in a drive method for the liquid crystal display device according to the first embodiment.
Figure 7:
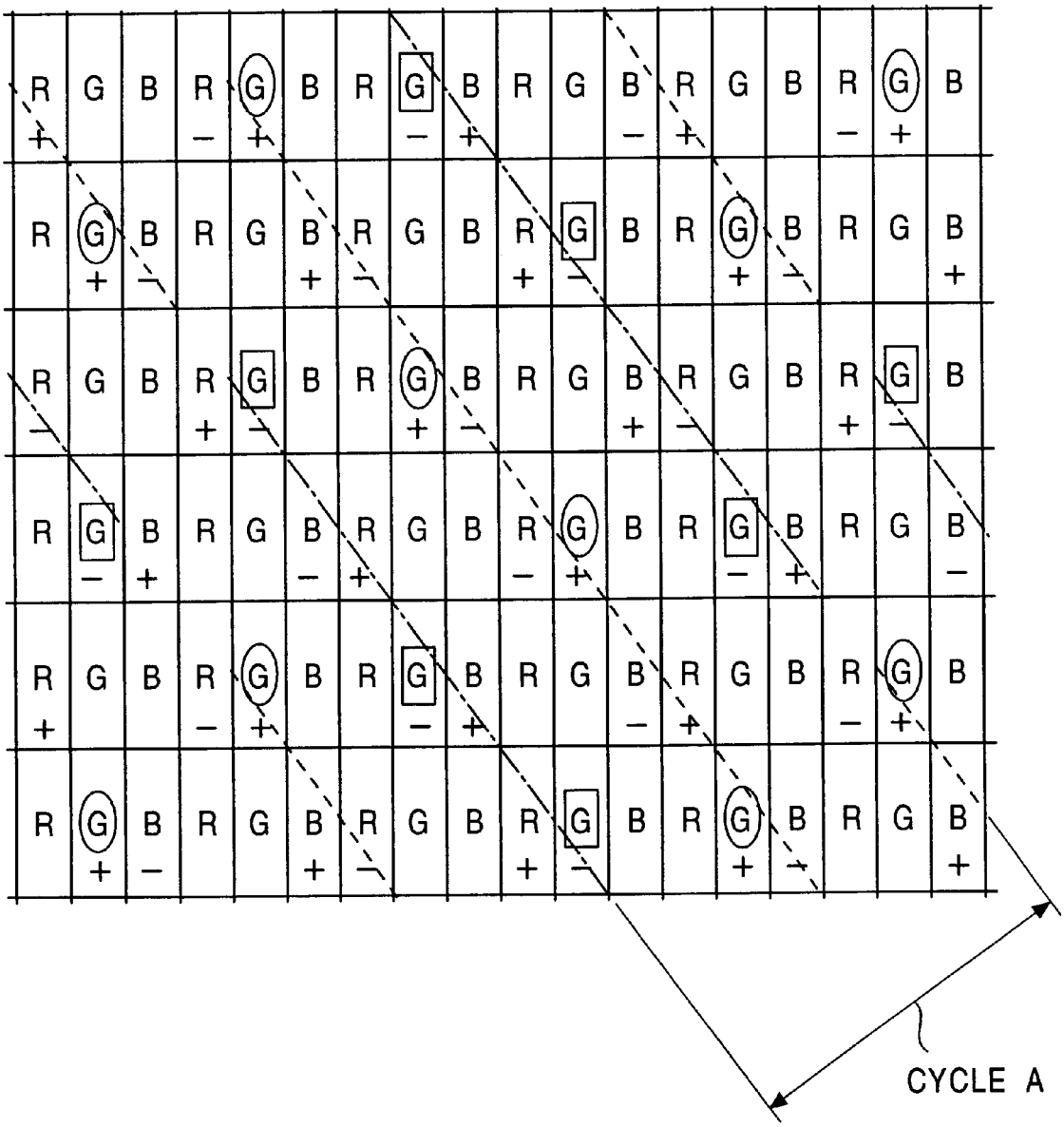
FIG. 7 is a chart!showing the drive voltage polarities and transmittance ratio distribution of dots in the second field in the drive method in FIG. 6.
Figure 8:
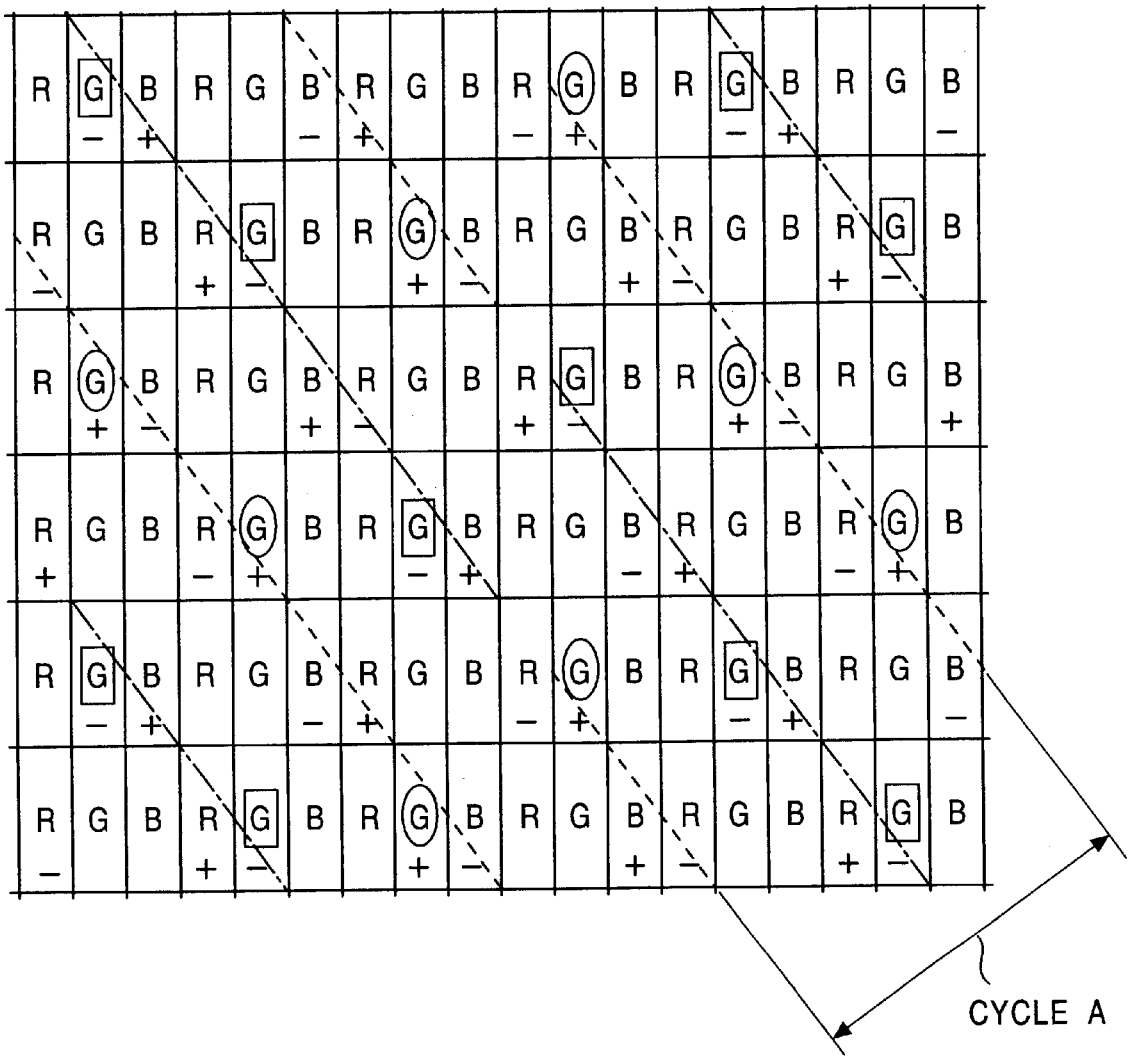
FIG. 8 is a chart:showing the drive voltage polarities and transmittance ratio distribution of dots in the third field in the drive method in FIG. 6.
Figure 9:
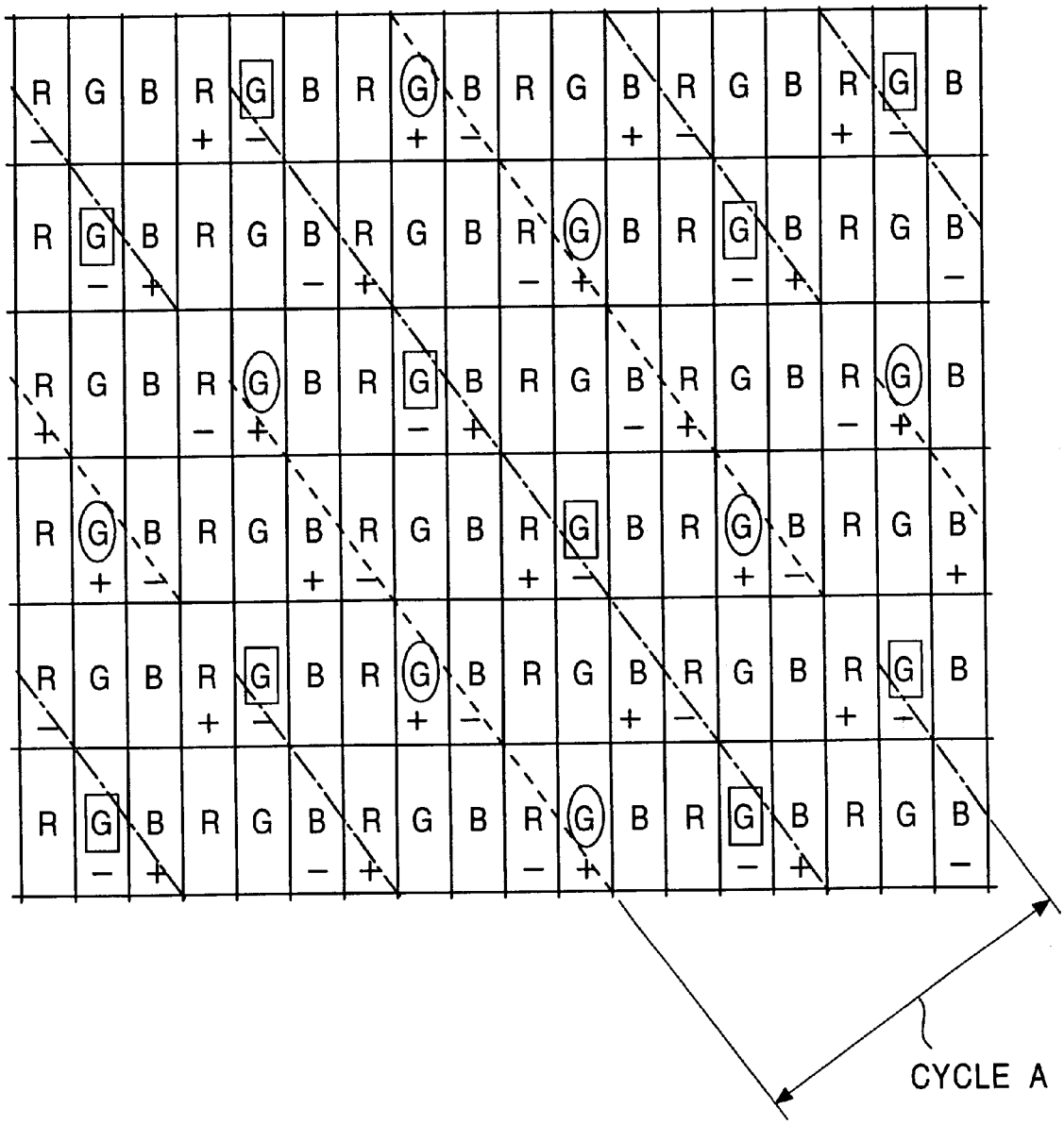
FIG. 9 is a chart showing the drive voltage polarities and transmittance ratio distribution of dots in the fourth field in the drive method in FIG. 6.

FIGS. 6 to 9 show the drive voltage polarities of dots in the first to fourth fields when the polarity inversion of every two dots connected to the same data line is performed in a direction along the gate line, and polarity inversion of every two dots is performed in a direction along the data line. FIG. 6 shows the first field, FIG. 7 shows the second field, FIG. 8 shows the third field, and FIG. 9 shows fourth field. In FIGS. 6 to 9, a dot indicated by enclosing G with an oval circle is a G dot to which a positive voltage is applied, and a dot indicated by enclosing G with a rectangle is a G dot to which a negative voltage is applied. A broken line which connects G dots to which a positive voltage is applied indicates a trough of a transmittance ratio distribution, and and alternate long and short dash line which connects G dots to which a negative voltage is applied indicates a crest of the transmittance ratio distribution.

A timing of polarity inversion performed every dot can be controlled by the count numbers of the horizontal counter 8 and the vertical counter 9 when a polarity control signal (POLE signal) is generated inside the control logic circuit 4.

Figure 14A:
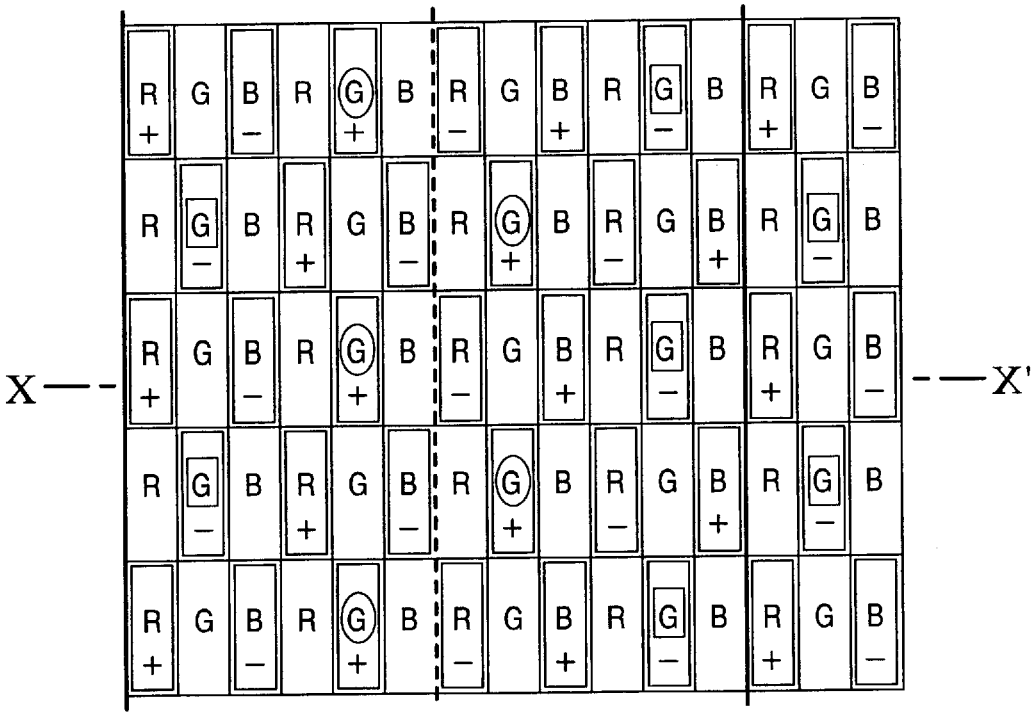
FIG. 14A PRIOR ART
FIG. 14A is a chart showing the drive voltage polarities of dots in one arbitrary field.
Figure 14B:
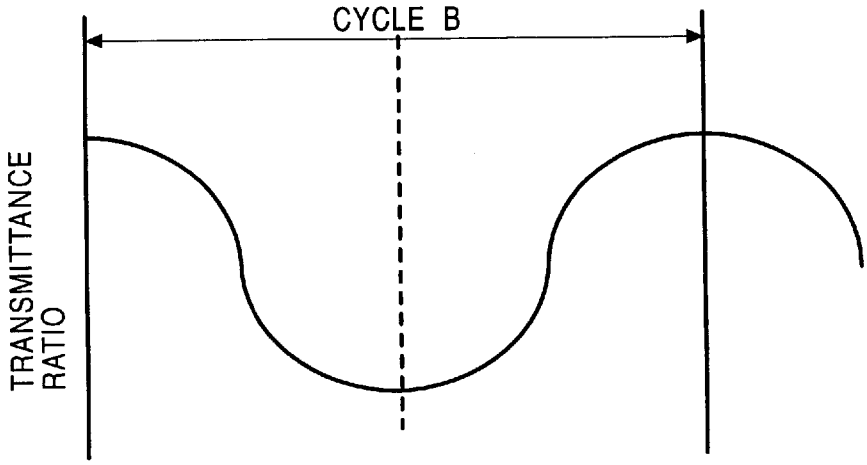
FIG. 14B PRIOR ART
FIG. 14B is a chart showing a transmittance ratio distribution of G dots corresponding to a line X–X" in FIG. 14A.

In a polarity inversion pattern according to this embodiment, as shown in FIGS. 6 to 9, a cycle A of the transmittance ratio distribution is almost half a cycle B obtained in the conventional drive method shown in FIG. 14B, and the spatial frequency of a variation in transmittance ratio becomes high. For example, when the crest portion of the transmittance ratio distribution indicated by the alternate long and short dash line is traced in a longitudinal direction, the crest portion is interrupted to be a trough portion indicated by a broken line. More specifically, unlike in the conventional drive method in which the crests and troughs of a transmittance ratio continue in a longitudinal direction, the crests and troughs of the transmittance ratio alternately appear in the longitudinal direction. As a result, according to the drive method of this embodiment, generation of a line crawling phenomenon can be prevented.

Second Embodiment

Figure 10:
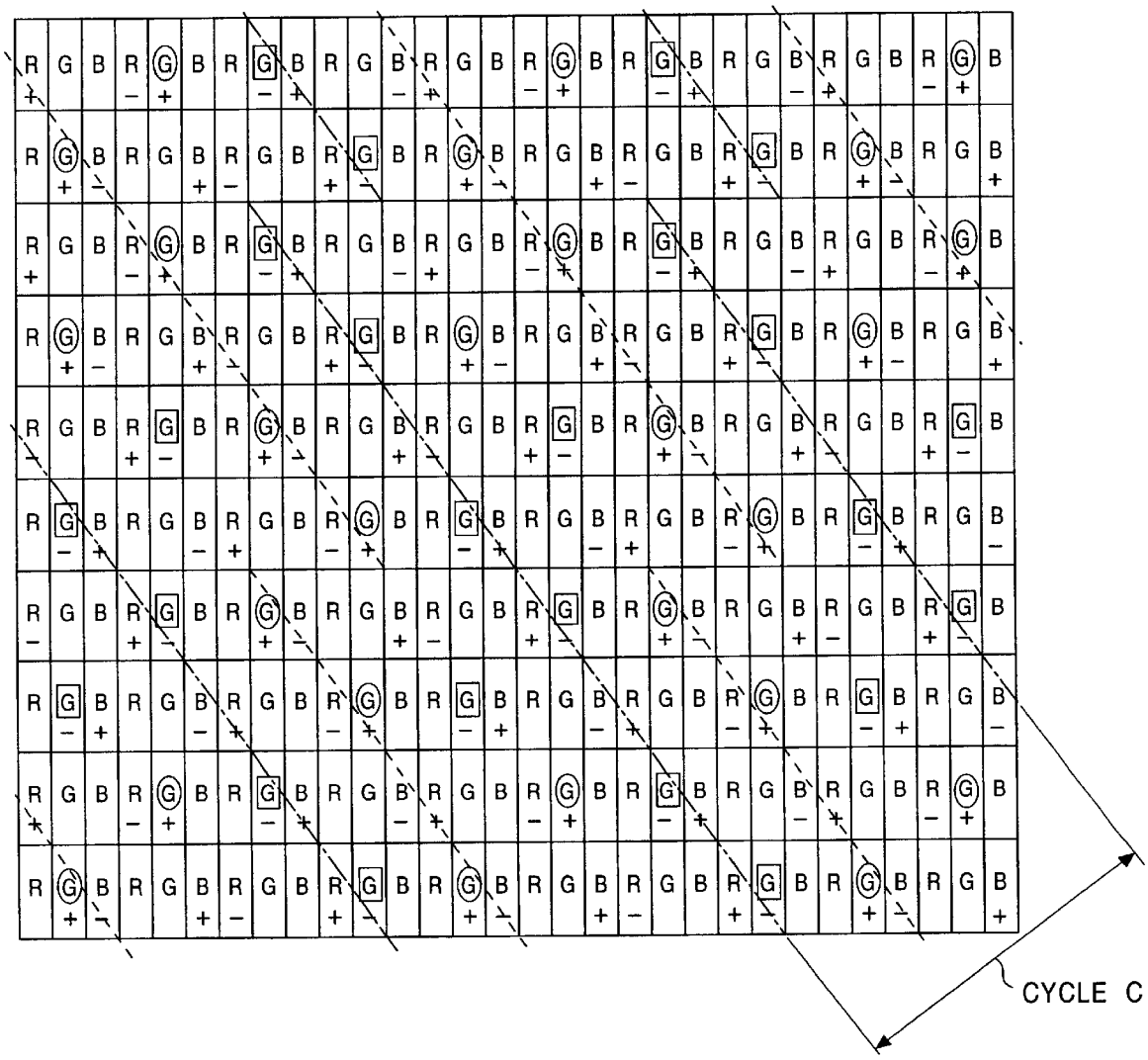
FIG. 10 is a chart showing the drive voltage polarities and transmittance ratio distribution of dots in one arbitrary field in a drive method for a liquid crystal display device according to the second embodiment.

The second embodiment of the present invention will be described below with reference to FIG. 10.

The second to fourth embodiments are different from the first embodiment in a drive method for a liquid crystal display device. Since the arrangement itself of the drive circuit is equal to the arrangement described in the first embodiment, a description of the drive circuit will be omitted.

In the drive method according to the second embodiment, polarity inversion of every data line is performed in a direction along a gate line, and polarity inversion of every four dots is performed in a direction along a data line. FIG. 10 is a chart showing the drive voltage polarities of dots in a certain field. A dot indicated by enclosing G with an oval circle is a G dot to which a positive voltage is applied, and a dot indicated by enclosing G with a rectangle is a G dot to which a negative voltage is applied. As shown in FIG. 10, in this embodiment, as in the first embodiment, a cycle C of a transmittance ratio is shorter than that in the conventional drive method, and it is understood that the crests and troughs of the transmittance ratio distribution intermittently and alternately appear. Therefore, generation of a line crawling phenomenon can also be prevented by the drive method according to this embodiment.

Third Embodiment

Figure 11:
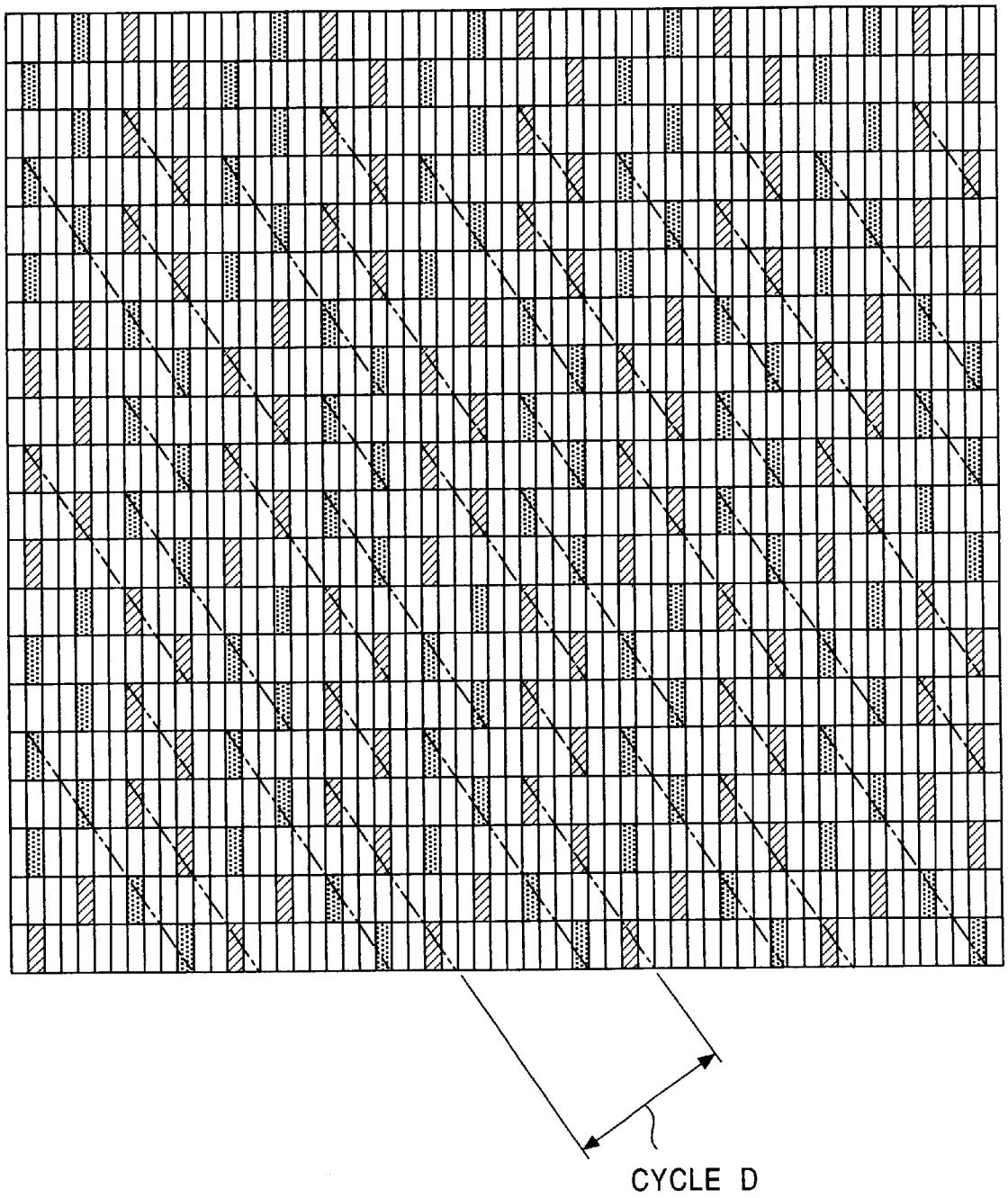
FIG. 11 is a chart showing the drive voltage polarities and transmittance ratio distribution of dots in one arbitrary field in a drive method for a liquid crystal display device according to the third embodiment.

The third embodiment of the present invention will be described below with reference to FIG. 11.

In a drive method according to the third embodiment, polarity inversion of: every data line is performed in a direction along a gate line, and polarity inversion of every six dots is performed in a direction along a data line. FIG. 11 is a chart showing the drive voltage polarities of dots in a certain field. For descriptive convenience, in FIG. 11, descriptions of "R", "G", and "B" of dots and descriptions of "+" and "−" are omitted. However, a dot on which an oblique line indicates a G dot to which a positive voltage is applied, and a dot on which dots are written indicates a G dot to which a negative voltage is applied. As shown in FIG. 11, in this embodiment, as in the above embodiments, a cycle D of a transmittance ratio is shorter than that in the conventional drive method, and the crests and troughs of the transmittance ratio distribution intermittently and alternately appear.

Fourth Embodiment

Figure 12:
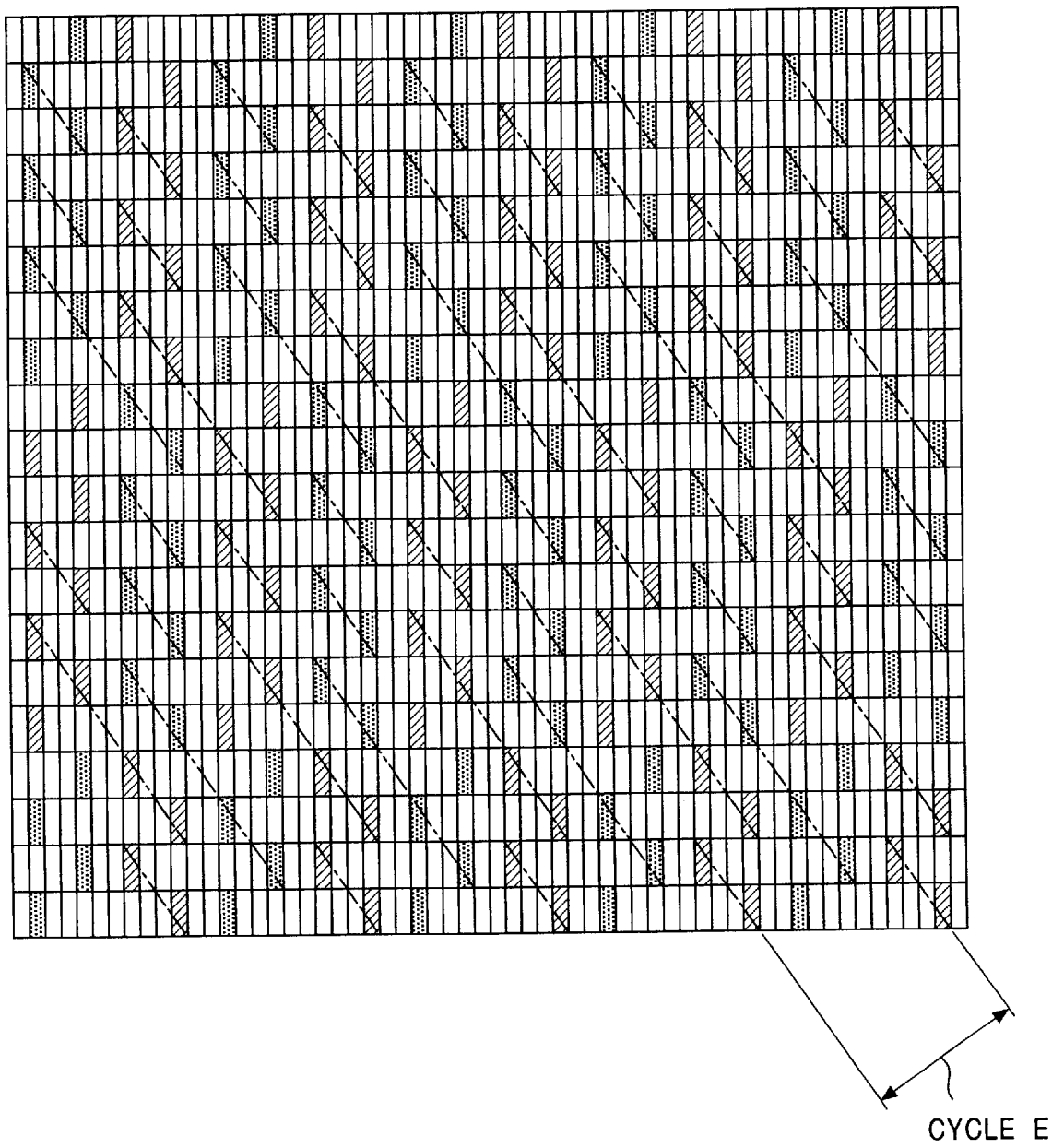
FIG. 12 is a chart: showing the drive voltage polarities and transmittance ratio, distribution of dots in one arbitrary field in a drive method for a liquid crystal display device according to the fourth embodiment.

The fourth embodiment of the present invention will be described below with reference to FIG. 12.

In a drive method according to the fourth embodiment, polarity inversion of every data line is performed in a direction along a gate line, and polarity inversion of every eight dots is performed in a direction along a data line. FIG. 12 is a chart showing the drive voltage polarities of dots in a certain field. For descriptive convenience, in FIG. 12, descriptions of "R", "G", and "B" of dots and descriptions of "+" and "−" are omitted. However, a dot on which an oblique line indicates a G dot to which a positive voltage is applied, and a dot on which dots are written indicates a G dot to which a negative voltage is applied. As shown in FIG. 12, in this embodiment, as in the above embodiments, a cycle E of a transmittance ratio is shorter than that in the conventional drive method, and the crests and troughs of the transmittance ratio distribution intermittently and alternately appear.

As is apparent from the above embodiments, in a liquid crystal display device of a double scanning line system having a lateral-stripe color filter and the matrix arrangement shown in FIG. 2, polarity inversion of every two dots connected to the same data line is performed in a direction along a gate line, and polarity inversion of every multiple-of-two pixel electrodes is performed in a direction along a data line, so that a line crawling phenomenon can be suppressed.

In contrast to this, a case wherein polarity inversion of every odd-number dots but every multiple-of-two dots is performed in a direction along a data line is used as a comparative example to check the presence/absence of generation of a liner crawling phenomenon. Polarity inversion of every one dot is performed by using conventional dot inversion, and generation of a line crawling phenomenon is described in the prior art. For this reason, polarity inversion performed every three dots will be described. A method of polarity inversion in a direction along a gate line is the same as that in the above embodiments.

Figure 13:
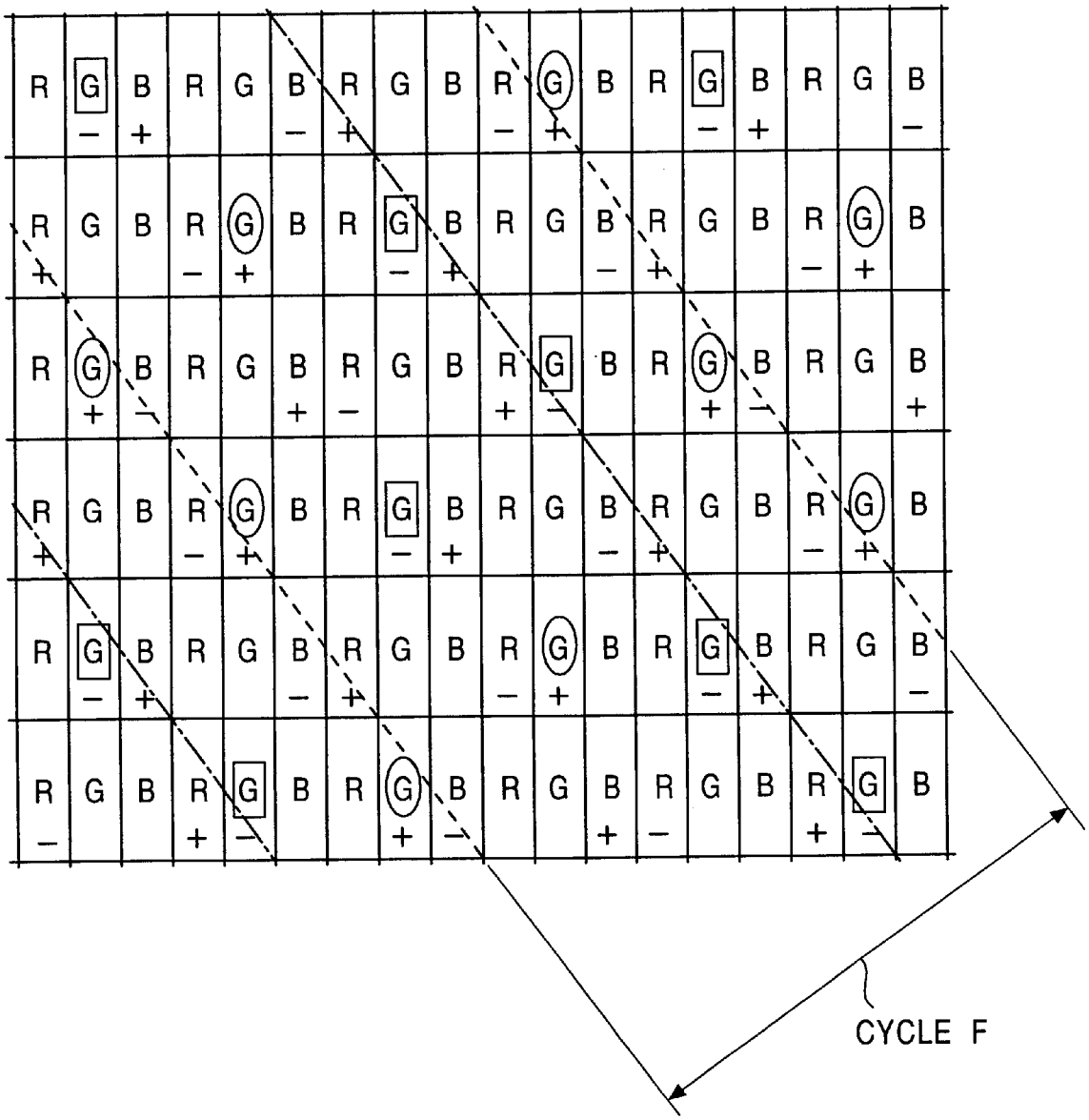
FIG. 13 is a chart showing the drive voltage polarities and transmittance ratio distribution of dots in one arbitrary field in a drive method according to a prior art.

FIG. 13 shows the drive voltage polarities of dots in an arbitrary field when polarity inversion of every three dots is performed in a direction along a data line. A dot indicated by enclosing G with an oval circle is a G dot to which a positive voltage is applied, and a dot indicated by enclosing G with a rectangle is a G dot to which a negative voltage is applied. As shown in FIG. 13, in the polarity inversion of every three dots, as in polarity inversion of every one dot, a cycle F of a transmittance ratio is elongated, and the crests and troughs of the transmittance ratio distribution continue in a longitudinal direction. For this reason, it is understood that a line crawling phenomenon is visually recognized in this drive method.

The technical scope of the present invention is not limited to the above embodiments, and various changes can be effected without departing from the scope of the invention. For example, concrete numeral values such as a size, the number of dots, and a dot pitch of a TFT-LCD panel unit in the above embodiment can be conveniently changed. The concrete arrangement of a drive circuit can also be changed.

As has described above, according to a drive method and a drive circuit for a liquid crystal display device according to the present invention, a spatial frequency of a variation in transmittance ratio during inversion driving can be made higher than that of a conventional drive method, and the method can give periodicity to a transmittance ratio distribution such that portions corresponding to the crests and troughs of the transmittance ratio distribution alternately appear. As a result, visual recognition of a line crawling phenomenon can be suppressed.

What is claimed is:

1. A circuit for driving a liquid crystal display coupled to a double scanning line system having a lateral stripe color filter, comprising:

electrodes arranged in rows and columns;

a plurality of data lines coupled to adjacent columns of the electrodes, the data lines separating pairs of the electrodes positioned in each row, each pair of the electrodes having gate terminals coupled together;

a plurality of gate lines coupled to each row of the electrodes, the gate lines separating the pairs of the electrodes in one row from adjacent pairs of electrodes in adjacent rows; and a control circuit coupled to selected electrodes positioned in a common column, the selected electrodes being an even multiple of electrodes in the common column, the control circuit being configured to supply drains of the selected electrodes with drain voltages having drain polarities by driving an inverting signal through the common data line that alternates the drain polarity of the selected electrodes.

2. The circuit of claim 1, wherein each pair of the electrodes separated by data lines having biased drains comprise an electrode having a positive drain bias coupled to an electrode having a negative drain bias.

3. The circuit of claim 1, wherein the control circuit is further configured to bias drains of second selected electrodes positioned adjacent to the selected electrodes, and wherein the second selected electrodes are directly coupled to the selected electrodes by one of the gate lines.

4. The circuit of claim 3, herein the control circuit is further configured to bias the drains of the selected electrodes with an alternating polarity to the polarity of the drains of the second selected electrodes.

5. The circuit of claim 3, wherein the control circuit is further configured to bias the drains of the selected electrodes in an alternating polarity along the common data line.

6. The circuit of claim 1, wherein the data lines are positioned directly between the pairs of electrodes positioned in each row.

7. The circuit of claim 1, wherein the selected electrodes are coupled to at least one adjacent electrode through a common gate line, the selected electrode having a drain bias of opposite polarity to a drain bias of said at least one adjacent electrode.

8. The circuit of claim 1, further comprising a color filter comprising primary colors, wherein each of the electrodes is coupled to one of the primary colors.

9. The circuit of claim 1, wherein crests and troughs of the transmittance ratio distribution are diagonal with respect to the data lines.

10. A circuit for driving a liquid crystal display coupled to a double scanning line system having a lateral stripe color filter, comprising:

electrodes arranged in rows and columns;

a color filter coupled to each electrode;

a plurality of data lines coupled to adjacent columns of the electrodes, the data lines separating pairs of the electrodes positioned in each row, each pair of the electrodes having gate terminals coupled together, the electrodes being biased when the drains of the electrodes are supplied with a drain voltage having a drain polarity;

a plurality of gate lines coupled to each row of the electrodes, the gate lines separating the pairs of the electrodes having biased drains in one row from adjacent pairs of electrodes having unbiased drains positioned in adjacent rows; and a control circuit coupled to selected electrodes positioned in a common column, the selected electrodes being an even multiple of electrodes in the common column, the control circuit being configured to bias drains of the selected electrodes by driving a signal having an alternating polarity through a common data line that alternates a drain polarity of adjacent selected electrodes.

11. The circuit of claim 10, wherein the plurality of data lines and the plurality of gate lines are substantially linear.

12. The circuit of claim 10, further comprising a plurality of common columns biased by the control circuit and comprising electrodes having biased drains separated by pluralities of the electrodes within the common columns having unbiased drains.

13. A method of driving a liquid crystal display display coupled to a double scanning line system having a lateral stripe color filter comprising:

coupling adjacent sources of electrodes to data lines;

coupling adjacent gates of the electrodes to gate lines;

arranging the electrodes into columns; and alternating a polarity of drains of selected electrodes that are positioned in one column and are coupled to a common data line by driving an inverting signal through the comman data line that alternates the drain polarity of the selected electrodes, the selected electrodes being an even multiple of electrodes along the one column; and biasing the gates of the selected electrodes by driving a second signal through the gate lines.

14. The method of claim 13, further comprising coupling each adjacent source of the electrodes to a common data line.

15. The method of claim 13, wherein each of the selected electrodes is coupled to an adjacent electrode through a common data line, and wherein the selected electrode and the adjacent electrode have a drain polarity.

16. The method of claim 13, further comprising arranging the electrodes in rows and coupling each row of electrodes to two gate lines.

17. The method of claim 13, further comprising biasing each drain of a plurality of adjacent selected electrodes with a voltage having a different polarity than the voltage of the drain of the selected electrodes.

18. The method of claim 13, wherein the liquid crystal display has a transmittance ratio comprising crest portions alternating between trough portions that traces through diagonal axes passing through a plurality of the electrodes.

19. A method of driving a liquid crystal display comprising:

coupling adjacent sources of electrodes to data lines;

coupling adjacent gates of the electrodes to gate lines;

arranging the electrodes into columns; and alternating a polarity of a voltage applied to drains of selected electrodes thereby biasing the selected electrodes, the selected electrodes being positioned in one column, coupled to a common data line, and separated by an electrode within the one column having an unbiased drain;

wherein the liquid crystal display has a transmittance ratio comprising crest portions alternating between trough portions that traces through at least a single longitudinal axes passing through a plurality of the electrodes.

20. In a liquid crystal display device of a double scanning line system having a lateral-stripe color filter, comprising a control circuit configured to generate a driving signal coupled to a plurality of electrodes through a signal line, the driving signal having an inverting polarity every multiple-of-two electrodes in a direction of the signal line, the control circuit being further configured to generate a liquid crystal drive voltage having an inverting polarity every two pixel electrodes that bias a plurality of gates of the plurality of electrodes, the liquid crystal drive voltage being applied in a direction of a gate line.

21. A circuit for driving a liquid crystal display, comprising:

electrodes arranged in rows and columns;

a plurality of data lines coupled to adjacent columns of the electrodes, the data lines separating pairs of the electrodes positioned in each row, each pair of the electrodes having gate terminals coupled together;

a plurality of gate lines coupled to each row of the electrodes, adjacent pairs of the electrodes connected with different gate lines; and a control circuit configured to supply a drive voltage to drains of diagonally adjacent electrodes connected to a common data line, the control circuit alternating a drain polarity of sets of the diagonally adjacent electrodes disposed an even number of electrodes along the common data line.

22. The circuit of claim 21, wherein the control circuit is further configured to sequentially supply a gate voltage to every other gate line.

23. The circuit of claim 21, wherein the control circuit is coupled to a set of electrodes that is adjacent to the selected electrodes, one electrode in the set of electrodes and one electrode in the selected electrodes form one of the pairs of electrodes, the control circuit being configured to supply drains of the set of electrodes with drain voltages such that the drain polarities of the pairs of electrodes are inverted from each other.

24. The circuit of claim 21, wherein the control circuit is coupled to the pairs of electrodes such that adjacent pairs of electrodes along one row are alternately biased and unbiased.

25. The circuit of claim 21, wherein the control circuit is coupled to the pairs of electrodes such that adjacent pairs of electrodes in different rows are alternately biased and unbiased.

26. The circuit of claim 21, wherein crests and troughs of the transmittance ratio distribution are diagonal with respect to the data lines.

* * * * *

UNITED STATES PATENT AND TRADEMARK OFFICE

CERTIFICATE OF CORRECTION

PATENT NO. : 6,552,707 B1
DATED : April 22, 2003
INVENTOR(S) : Tatsumi Fujiyoshi It is certified that error appears in the above-identified patent and that said Letters Patent is hereby corrected as shown below:

Column 9,
Line 58, delete “herein” and substitute -- wherein -- in its place.

Column 10,
Line 45, delete “display” (second occurrence).
Line 55, delete “comman” and substitute -- common -- in its place.

Signed and Sealed this

Second Day of September, 2003

JAMES E. ROGAN
*Director of the United States Patent and Trademark Office*